United States Patent [19]

DeLuca

[11] Patent Number: 4,823,514

[45] Date of Patent: Apr. 25, 1989

[54] AIR GRINDER MOTOR VIBRATING SANDING ACCESSORY FOR AUTO BODY WORK AND THE LIKE

[76] Inventor: Mario S. DeLuca, 15 Danville Dr., Greenlawn, N.Y. 11740

[21] Appl. No.: 146,493

[22] Filed: Jan. 21, 1988

[51] Int. Cl.[4] ..... B24B 23/02

[52] U.S. Cl. ..... 51/170 MT; 15/22 R

[58] Field of Search ..... 51/170 R, 170 MT, 170 T; 15/22 R

[56] References Cited

U.S. PATENT DOCUMENTS

| | | | |
|---|---|---|---|
| 2,282,145 | 5/1942 | Indge | 51/170 T |
| 2,614,369 | 10/1952 | Robins | 51/170 MT |
| 3,184,894 | 5/1965 | Bayes | 51/170 R |
| 3,482,362 | 12/1969 | Bangerter et al. | 51/170 R |
| 3,875,703 | 4/1975 | Clemente | 51/170 T |
| 4,420,908 | 12/1983 | Reiling et al. | 51/170 T |
| 4,610,111 | 9/1986 | Cox | 51/170 MT |

*Primary Examiner*—Roscoe V. Parker

*Attorney, Agent, or Firm*—Richard L. Miller

[57] ABSTRACT

This air grinder motor vibrating sanding accessory is designed for auto body work and the like. Primarily, it consists of a main body having an eccentric mounted shaft with a head that receives a sanding disc or other abrasive device.

3 Claims, 1 Drawing Sheet

FIG. 1
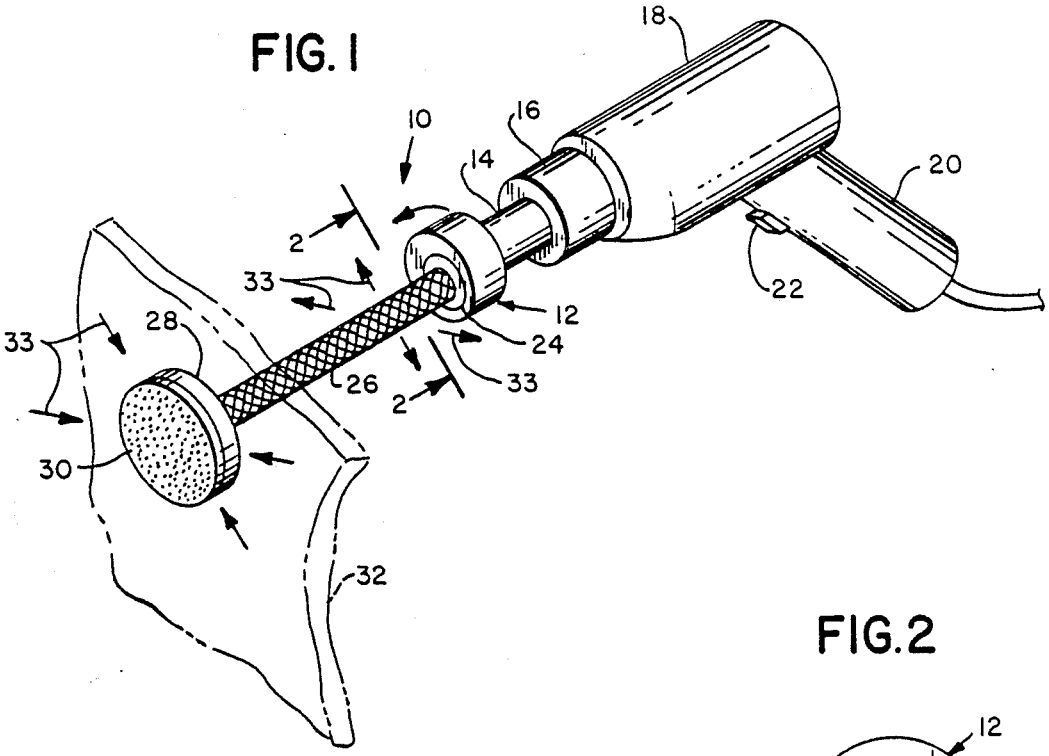
FIG. 2
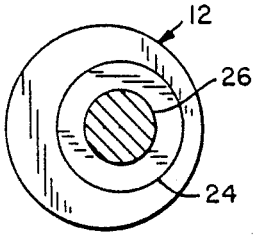
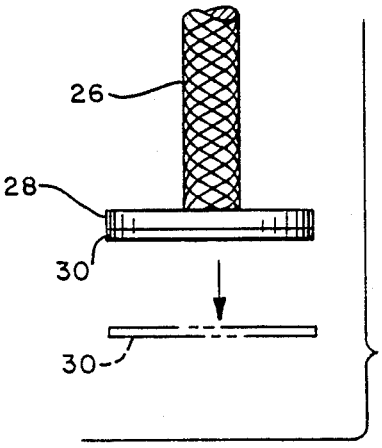
FIG. 4
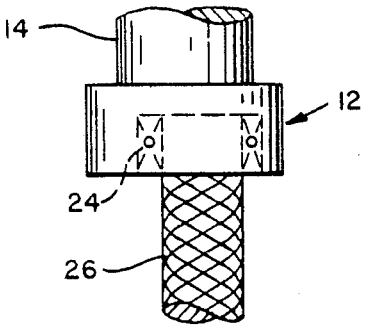
FIG. 3

AIR GRINDER MOTOR VIBRATING SANDING ACCESSORY FOR AUTO BODY WORK AND THE LIKE

BACKGROUND OF THE INVENTION

The instant invention relates generally to power tools, and more particularly, to an air grinder motor vibrating sanding accessory for auto body work and the like.

Numerous accessories have been provided in the prior art that are adapted to be employed with power tools. For example, U.S. Pat. Nos. 4,610,111 of Cox; 4,420,908 of Reiling et al; and 2,614,369 of Robins, all are illustrative of such prior art. While these units may be suitable for the particular purpose to which they address, they would not be as suitable for the purpose of the present invention as hereafter described.

SUMMARY OF THE INVENTION

A primary object of the present invention is to provide an air grinder motor vibrating sanding accessory for auto body work and like that will overcome the shortcomings of the prior art devices.

Another object is to provide an air grinder motor vibrating sanding accessory for auto body work and the like, which will be so designed, as to provide an oscillating motion for sanding purposes.

An additional object is to provide an air grinder motor vibrating sanding accessory for auto body work and the like, which will be so designed, as to include a shaft that is eccentric for effecting the oscillating motion.

A further object is to provide an air grinder motor vibrating sanding accessory for auto body work and the like that is simple and easy to use.

A still further object is to provide an air grinder motor vibrating sanding accessory for auto body work and the like that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective of the instant invention installed in a typical drill and being used on a fragmentary work piece shown in phantom;

FIG. 2 is an enlarged transverse cross sectional view taken on line 2—2 in FIG. 1;

FIG. 3 is a fragmentary diagrammatic vertical elevational view of just a portion of the instant invention per se; and FIG. 4 is an enlarged fragmentary vertical view of just the sanding end of the instant invention showing the disk exploded therefrom, in phantom.

DETAILED DESCRIPTION OF THE PREFERRED EMBODIMENTS

Turning now descriptively to the drawings, in which like reference characters denote like elements throughout the several views, an accessory 10 is shown to include a main body 12 having a shaft 14 that mounts in chuck 16 of air grinder motor 18 that includes a handle 20 with a switch 22 therein. A bearing 24 is mounted eccentrically in main body 12, and a knurled shank 26 is journaled within bearing 24.

A circular plate head 28 is integrally attached to the other end of the shank 26 and a sand disc 30 is adhered to head 28 for abrasive engagement with auto body metal 32. The shank 26 is also knurled on its outer periphery, for a non-slip grip when using accessory 10.

In use, air grinder motor 18 is held by its handle 22 and the operator holds the knurled shank 26 in the other hand, the oscillatory motion of accessory 10 being indicated by the arrows 33.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An air grinder motor vibrating sanding accessory for auto body work and the like, comprising, a main body, a shaft integrally attached to said main body, for mounting said accessory in a chuck of an air grinder motor, a bearing mounted eccentrically in said main body, rotatively securing a knurled shank with head means for placement of a sanding disc thereon.

2. An air grinder motor vibrating sanding accessory for auto body work and the like, as set forth in claim 1, wherein said bearing is secured in an opening eccentric with a longitudinal axis of said main body and one end of said knurled shank is received in said bearing.

3. An air grinder motor vibrating sanding accessory for auto body work and the like as set forth in claim 2, wherein said head means is circular and integrally attached to another end of said shank and said sanding disc is removably adhered to a face of said head means, whereby said air grinder motor may be held in one hand of an operator and said shank held in another hand of said operator, causing said sanding disc to move in an oscillating manner while engaged with metal of a work piece.

* * * * *